US007854078B2

(12) United States Patent
Hall et al.

(10) Patent No.: US 7,854,078 B2
(45) Date of Patent: Dec. 21, 2010

(54) CHAIN ASSEMBLY

(76) Inventors: David R. Hall, 2185 S. Larsen Pkwy., Provo, UT (US) 84606; Ronald Crockett, 2185 S. Larsen Pkwy., Provo, UT (US) 84606; Sigmar Tobias, 2185 S. Larsen Pkwy., Provo, UT (US) 84606; Tyson J. Wilde, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 12/173,123

(22) Filed: Jul. 15, 2008

(65) Prior Publication Data

US 2010/0011628 A1 Jan. 21, 2010

(51) Int. Cl.
*E02F 3/14* (2006.01)

(52) U.S. Cl. ..... 37/465

(58) Field of Classification Search ..... 30/346.54, 30/350; 76/101.1, 24.1, 24; 37/355, 465, 37/352, 357, 359, 367–369; 299/34.01, 39, 299/81; 501/87, 127, 96.3
See application file for complete search history.

(56) References Cited

U.S. PATENT DOCUMENTS

| | | | | | |
|---|---|---|---|---|---|
| 5,056,227 | A * | 10/1991 | Kramer | 30/346.54 |
| 5,199,197 | A * | 4/1993 | Thuerman | 37/465 |
| 5,248,188 | A * | 9/1993 | Walgren | 299/83.1 |
| 5,413,016 | A * | 5/1995 | Kranz et al. | 76/108.1 |
| 5,471,771 | A * | 12/1995 | Gilbert | 37/352 |
| 6,012,241 | A * | 1/2000 | Pasienski et al. | 37/465 |
| 6,154,987 | A * | 12/2000 | Rumer et al. | 37/352 |
| 7,375,044 | B2 * | 5/2008 | Yeckley et al. | 501/87 |
| 7,413,256 | B2 * | 8/2008 | Hall et al. | 299/104 |

* cited by examiner

*Primary Examiner*—Robert E Pezzuto
(74) *Attorney, Agent, or Firm*—Tyson J. Wilde; Philip W. Townsend, III

(57) ABSTRACT

In one aspect of the invention, a chain assembly comprises a boom comprising a sliding surface and a plurality of chain links adapted to slide along the sliding surface. At least one polycrystalline ceramic enhanced insert at an interface between the chain links and at least a portion of the sliding surface.

18 Claims, 13 Drawing Sheets

CHAIN ASSEMBLY

BACKGROUND OF THE INVENTION

Efficient degradation of materials is important to a variety of industries including the asphalt, mining, construction, drilling, and excavation industries. In asphalt recycling and trenching, a drum or chain supporting an array of picks may rotate such that the picks engage a paved surface causing it to break up. Examples of degradation assemblies from the prior art are disclosed in U.S. Pat. No. 6,824,225 to Stiffler, US Pub. No. 20050173966 to Mouthaan, U.S. Pat. No. 6,692,083 to Latham, U.S. Pat. No. 6,786,557 to Montgomery, Jr., U.S. Pat. No. 3,830,321 to McKenry et al., US. Pub. No. 20030230926, U.S. Pat. No. 4,932,723 to Mills, US Pub. No. 20020175555 to Merceir, U.S. Pat. No. 6,854,810 to Montgomery, Jr., U.S. Pat. No. 6,851,758 to Beach, which are all herein incorporated by reference for all they contain.

BRIEF SUMMARY OF THE INVENTION

In one aspect of the invention, a chain assembly comprises a boom comprising a sliding surface and a chain link adapted to slide along the sliding surface. At least one polycrystalline ceramic enhanced insert at an interface between the chain links and at least a portion of the sliding surface.

The ceramic may comprise a polycrystalline diamond, a cemented metal carbide, or cubic boron nitride. The at least one insert may be attached to a chain link. The at least one insert may be attached to the sliding surface. A track may be formed in the sliding surface. The track may comprise at least one groove. The groove may be lined with a wear resistant material. The track may comprise at least one protrusion. The at least one insert may be attached to a wear plate in part making up the sliding surface. The chain assembly may comprise at least two links arranged across the width of the chain link and an insert may be bonded to a single side of each link. A chain link may comprise at least one insert on a front end and a rearward end of the link. The link may comprise a pin adapted to connect the link to an adjacent link, the pin may also comprise a ceramic enhancement. The boom may comprise a pivot end attached to a vehicle. The boom may incorporate into a trenching machine. The boom may incorporate into an excavator. The boom may incorporate into a saw.

In another aspect of the invention, a chain assembly comprises a boom comprising a sliding surface and a chain link adapted to slide along the sliding surface. At least one polycrystalline ceramic enhanced insert is attached to a chain link. The insert is adapted to slide against the sliding surface.

In yet another aspect of the invention an assembly comprises a boom comprising a sliding surface and a chain link adapted to slide along the sliding surface. At least one polycrystalline ceramic enhanced insert is bonded to the sliding surface. The insert is adapted to slide against the chain link.

DETAILED DESCRIPTION OF THE INVENTION AND THE PREFERRED EMBODIMENT

Figure 1:
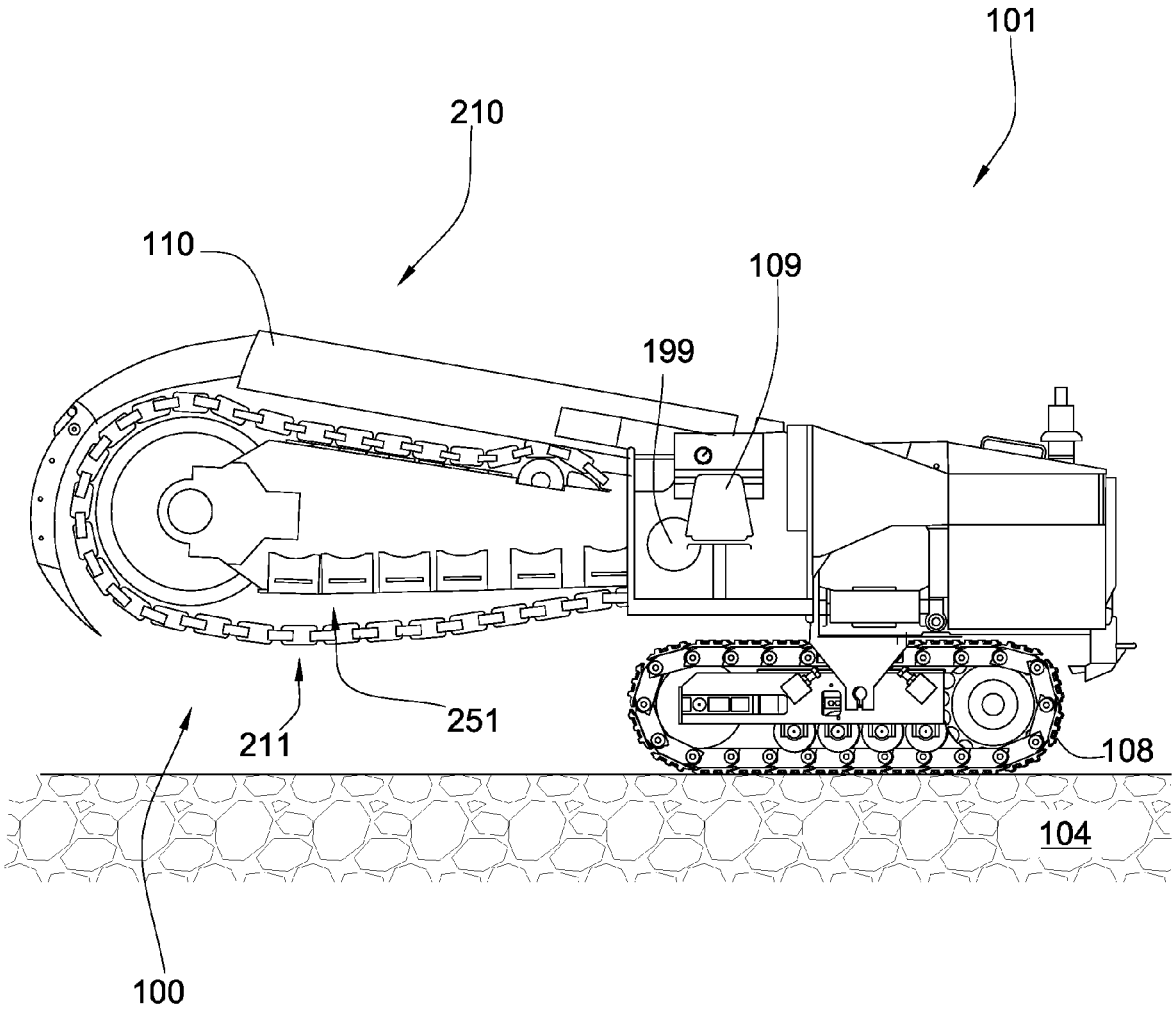
FIG. 1 is a perspective diagram of an embodiment of a trenching machine.

In reference to FIG. 1, a boom 100 is attached to a trenching machine 101. The boom 100 may be pivotally attached to the trenching machine 101 with an axle 199. The boom 100 may have a topside 210 and the underside 211. The trenching machine 101 may be used to degrade hard or soft formations. Chain links may be rotatably mounted to the boom 100 along a sliding surface 251 which incorporates the topside and underside. The position of the boom 100 may be controlled by a hydraulic arm (not shown). The trenching machine may move about the formation 104 by tracks 108, wheels, or a combination thereof. A seat 109 for an operator is positioned on the side of the machine. A shield 110 may be disposed over the topside 210 of the boom 100.

Figure 2:
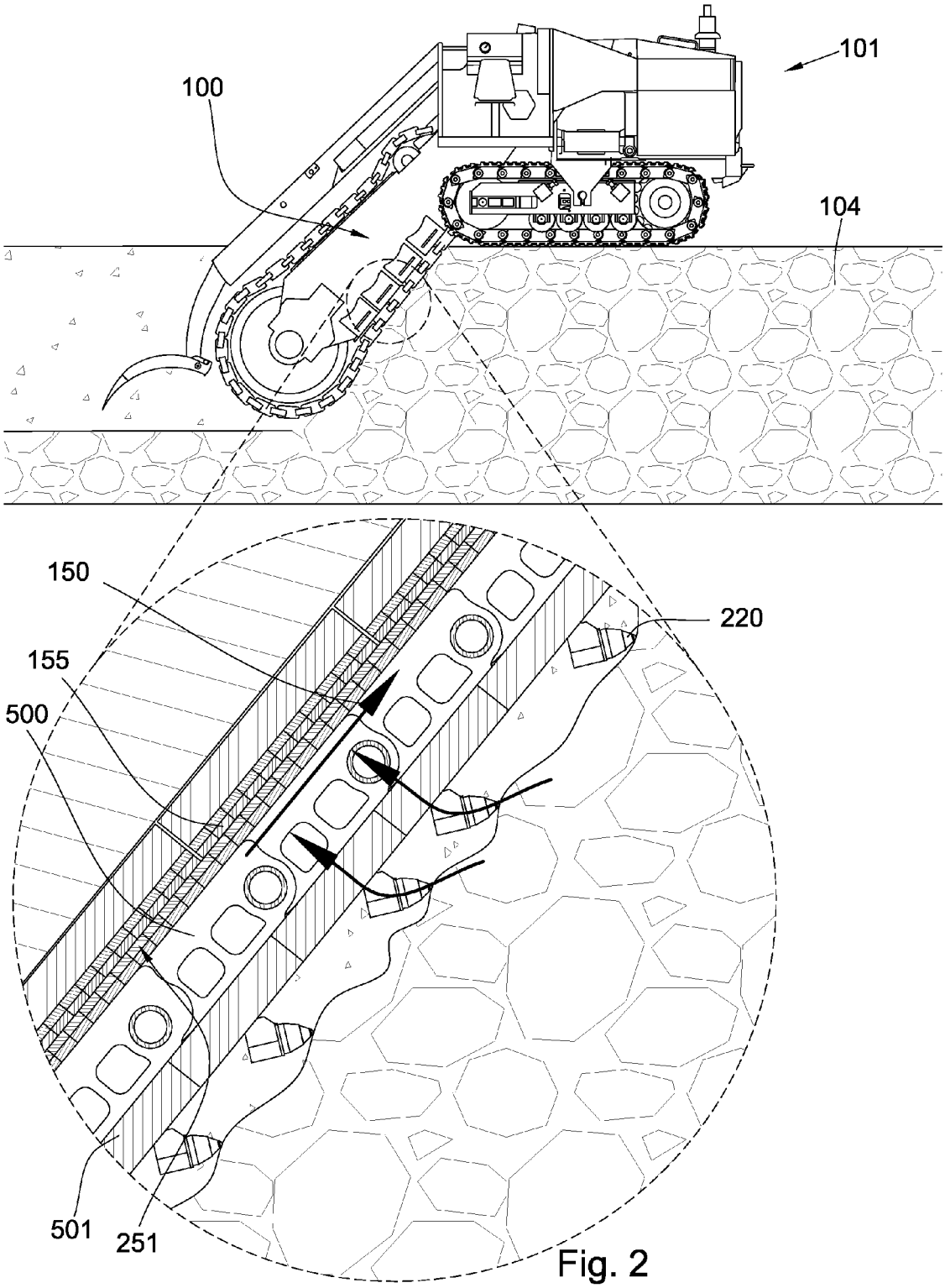
FIG. 2 is a perspective diagram of an embodiment of a trenching machine with detail.

FIG. 2 is a perspective diagram of an embodiment of a trenching machine 101. A plurality of chain links may be arranged lengthwise and positioned around the topside and underside of the boom along its sliding surface 251. The boom 100 may be raised for transportation purposes and/or lowered to engage a formation 104. The action of the chain assembly may cut a trench and pull aggregate out of the trench. The weight of the boom 100 in combination with the reaction forces of the formation may load the sliding surface and the chain link as they slide across each other. In the embodiment of FIG. 2, the sliding surface 251 of the boom and the links 500 of the chain assembly incorporate a polycrystalline ceramic enhanced insert 150 which is believed to reduce friction between them as well as reduce heat and horsepower. Preferably the ceramic is sintered polycrystalline diamond which is bonded to a tungsten carbide substrate, although other cemented metal carbide substrates would be compatible with the present invention. In other embodiments, the inserts are enhanced with cubic boron nitride, silicon carbide, or a cemented metal carbide. The links 500 are attached to degradation plates 250 which have pick assemblies 220 mounted thereon.

Figure 3A:
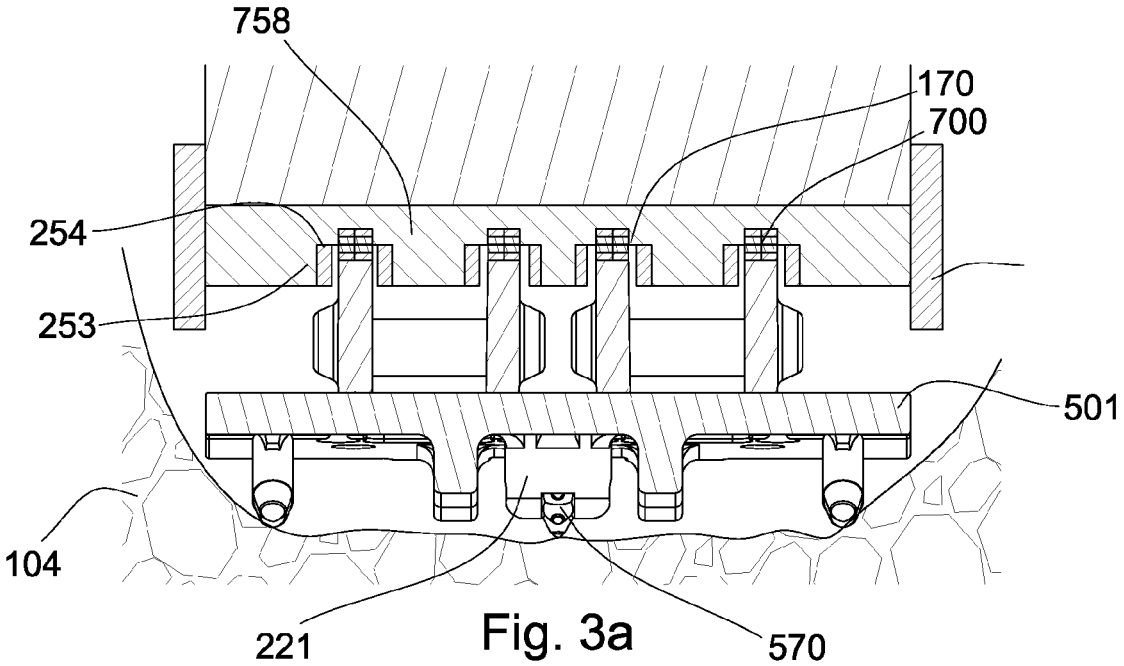
FIG. 3*a* is a cross-sectional view of an embodiment of a chain link and plate.
Figure 3B:
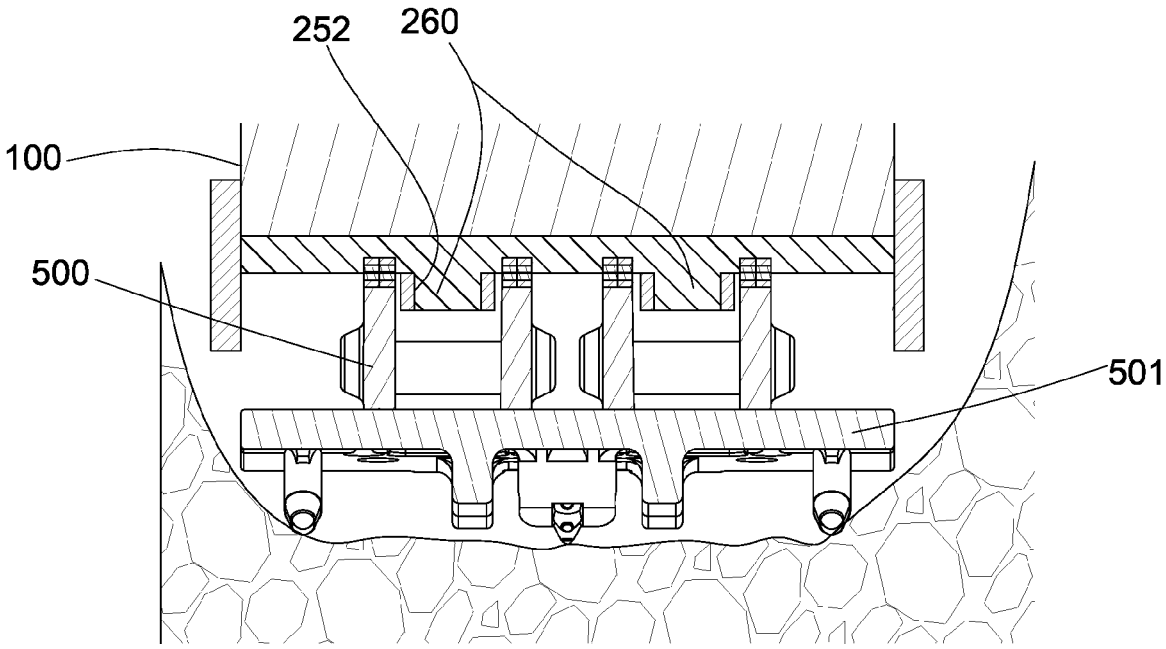
FIG. 3*b* is a cross-sectional view of another embodiment of a chain link and plate.

In reference now to FIGS. 3*a* and 3*b*, a wear plate 758 may form the sliding surface 251. The wear plate 758 may be secured to a side of the boom through a pair of side plates 757 which are welded, bolted or otherwise secured to the side. The slide plates may incorporate slots which receive arms of the wear plate. A track formed in the sliding surface may reduce side wobble in the chain links as it moves. Such a track may restrict the path of the links and thereby minimize the portion of the sliding surface exposed to wear. The track may be formed by grooves 170 as disclosed in FIG. 3*a* or by protrusions 260 as disclosed in FIG. 3*b*. The groove sides 253 and/or protrusion sides 252 may be lined with side inserts 254, such as a substantially rectangular carbide insert. These inserts may be designed to accommodate the side loads of the chain links. Ceramic enhanced inserts 150, such as those adapted to reduce the friction between the links and the sliding surface, may be positioned along the width and length of the sliding surface and may be adapted to accommodate a thrust load as well.

In embodiments, wherein the ceramic is diamond, the diamond may comprise a binder concentration of 1 to 40 weight percent. The diamond may be a refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, monolithic diamond, polished diamond, course diamond, fine diamond, non-metal catalyzed diamond, or combinations thereof. In some embodiments, the diamond may further comprise binders selected from the group consisting of chromium, titanium, aluminum, tungsten, carbonates, calcium, phosphorous, or combinations thereof.

In the preferred embodiment, the ceramic enhanced insert comprises a sintered polycrystalline diamond with a substantially cylindrical shape. The inserts may be as wide as two inches in diameter. In some embodiments, the inserts are approximately or less than a half inch in diameter. The diamond is supported by a carbide substrate where they are bonded to each other at a non-planar interface. In some embodiments, the edges of the inserts are rounded, chamfered, and/or beveled to reduce the likelihood that the inserts will snag each other as they slide across each other.

The degradation plate 501 may comprise a roller assembly 221. The roller assembly 221 may comprise pointed inserts 570 adapted to contact a formation 104. The inserts may be press fit into the pockets formed in the boom and/or the wear plate. The inserts 570 may be positioned on the topside or underside of the boom. In some embodiments, the inserts are welded or brazed to the wear plate 758 and/or boom 100. The inserts may also be press fit, brazed or welded to the links 500.

One benefit of diamond is its high thermal conductivity. Any heat generated by friction between inserts sliding against each other may be conducted by the diamond away from the heat origination spots and spread thus reducing extreme hot spots in the chain assembly. Cubic boron nitride and various forms of carbide may also help spread the heat, but are not believed to spread the heat as efficiently as diamond.

Figure 3C:
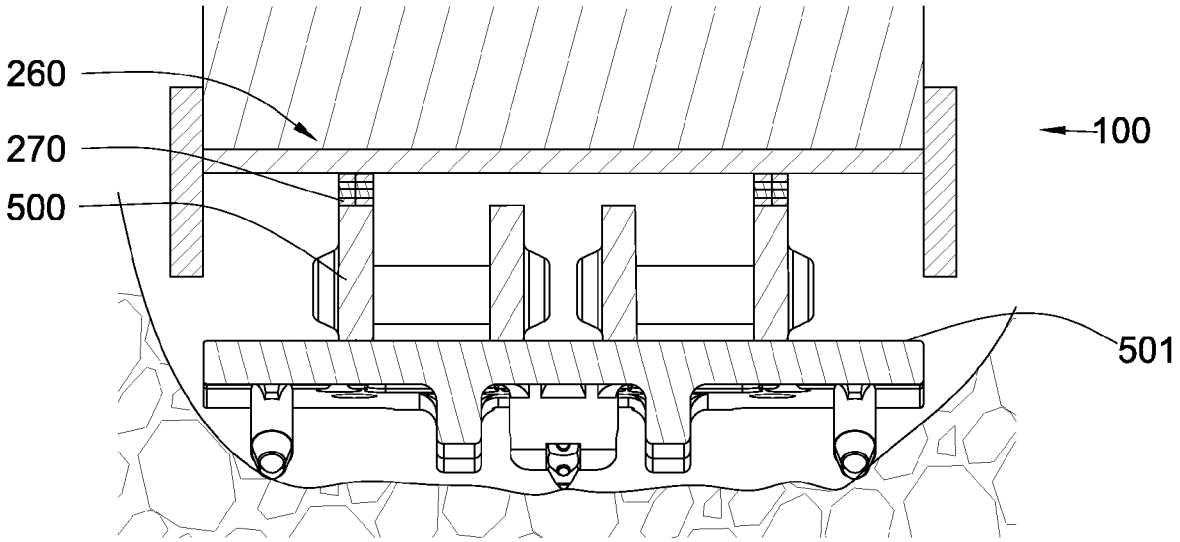
FIG. 3*c* is a cross-sectional view of another embodiment of a chain link and plate.

FIG. 3*c* discloses inserts 150 disposed on the far sides of the links. It is believed that a majority of the load experienced by the chain assembly may be concentrated on the outer portion of the chain links 500. In embodiments where two links are bonded to the degradation plates, the load may be picked up at the far sides of the links and eliminate the contact of the inner sides from contact with the sliding surface, thus reducing heat and friction.

Figure 4:
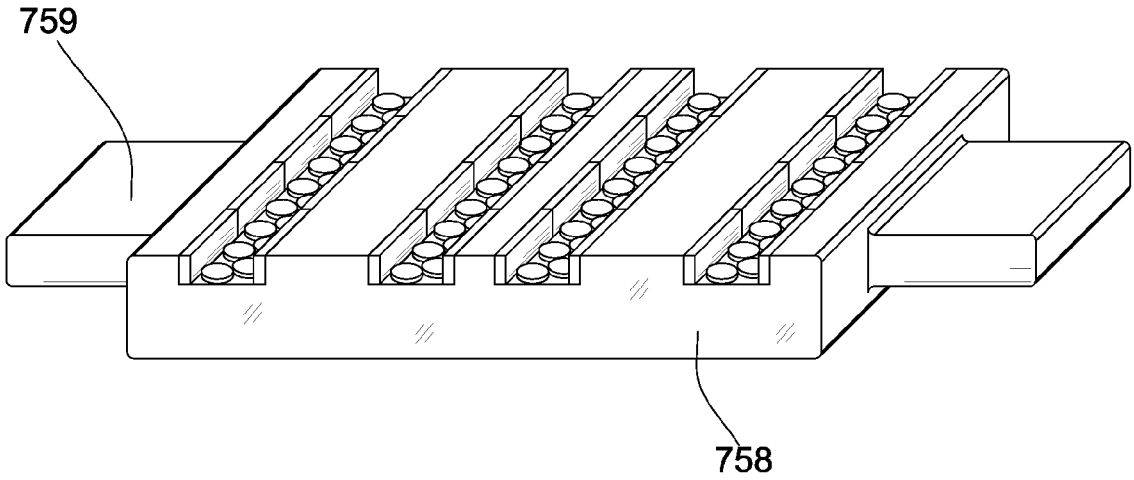
FIG. 4 is a perspective diagram of an embodiment of a wear plate.

FIG. 4 discloses a plate 758 with arms 759. The arms 759 may be adapted to connect to a pair of side plates 757 (shown in FIG. 3*a*). The pair of side plates 757 may be adapted to be secured to the boom 100 (shown in FIG. 3*a*). Grooves are formed in the plate 758 where the links are anticipated to contact the plate. The grooves may be lined with inserts on the bottom and/or side of the groove.

Figure 5:
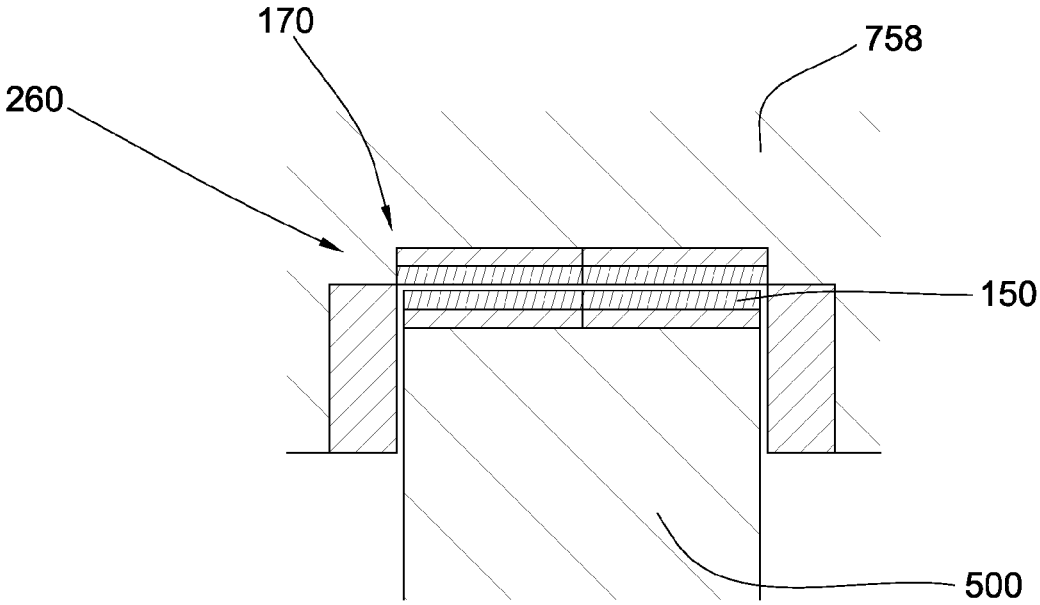
FIG. 5 is a cross-sectional diagram of an embodiment of a chain link and groove.

FIG. 5 discloses a cross-sectional diagram of an embodiment of a chain link 500 and groove 170. The chain link 500 as well as the bottom of the groove may comprise inserts 150 which may act to spread heat and reduce friction. Preferably, these inserts comprise a carbide substrate and bonded to sintered polycrystalline diamond. Rectangular inserts of a cemented metal carbide may be bonded to the sides of the grooves to accommodate the side loads.

Figure 6A:
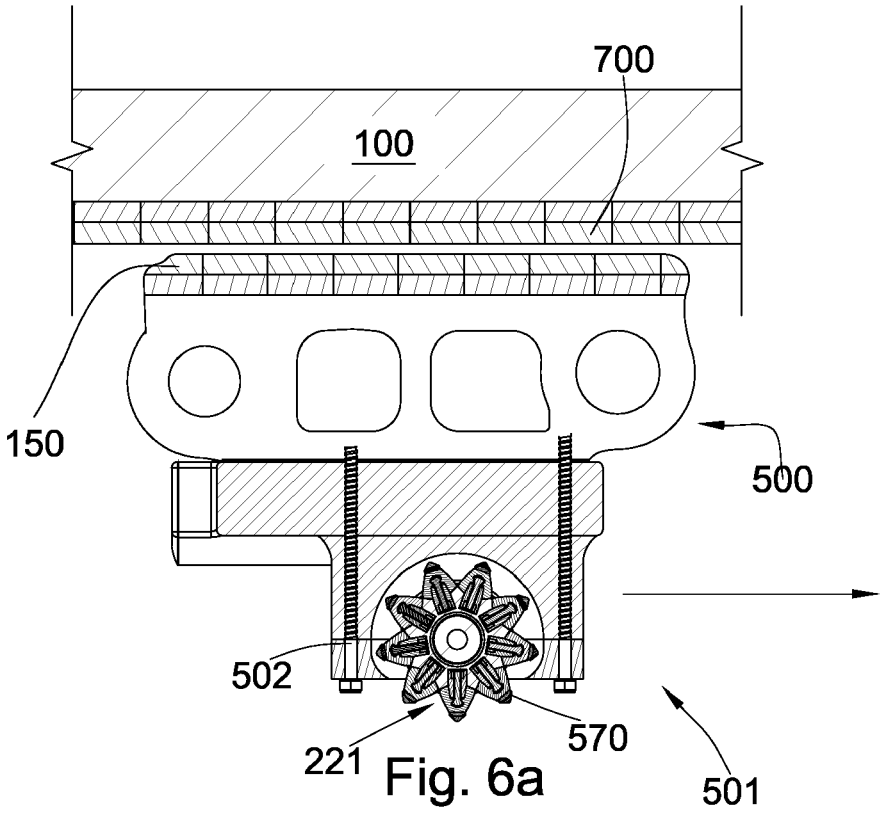
FIG. 6*a* is a cross-sectional view of an embodiment of a chain assembly.

FIG. 6*a* discloses a cross-sectional diagram of an embodiment of a chain link 500 and degradation plate 501. The chain link 500 may comprise inserts 150 adapted to reduce friction. The degradation plate 501 may comprise a roller assembly 221 and/or picks (not shown) adapted to engage a formation. The roller assembly 221 may comprise a plurality of pointed inserts 570. The degradation plate 501 may be secured to the chain link 500 through mechanical fasteners 502. Both the link and the sliding surface of the boom are lined with inserts.

Figure 6B:
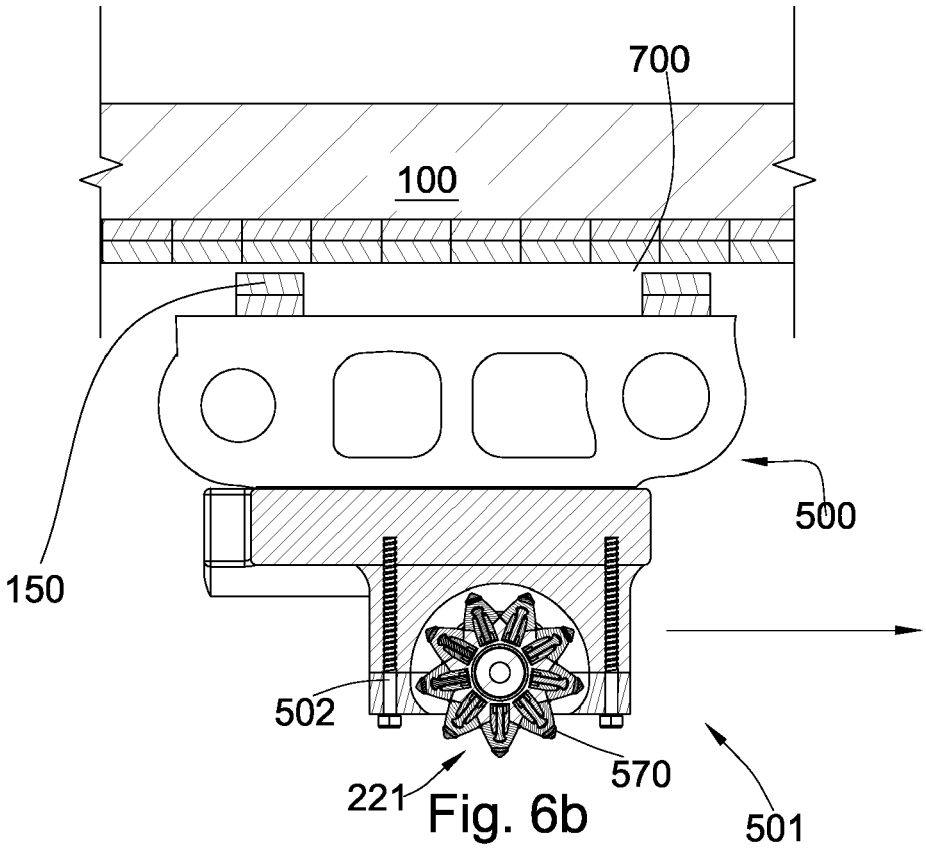
FIG. 6*b* is a cross-sectional view of another embodiment of a chain assembly.

FIG. 6*b* discloses a cross-sectional diagram of an embodiment of a chain link 500 and degradation plate 501. In this embodiment, the link comprises fewer inserts. This reduces the contact between inserts and thereby reduces friction and costs. Diamond enhanced inserts on the link may be well suited to the increased load since there are fewer inserts to spread the load between.

Figure 7:
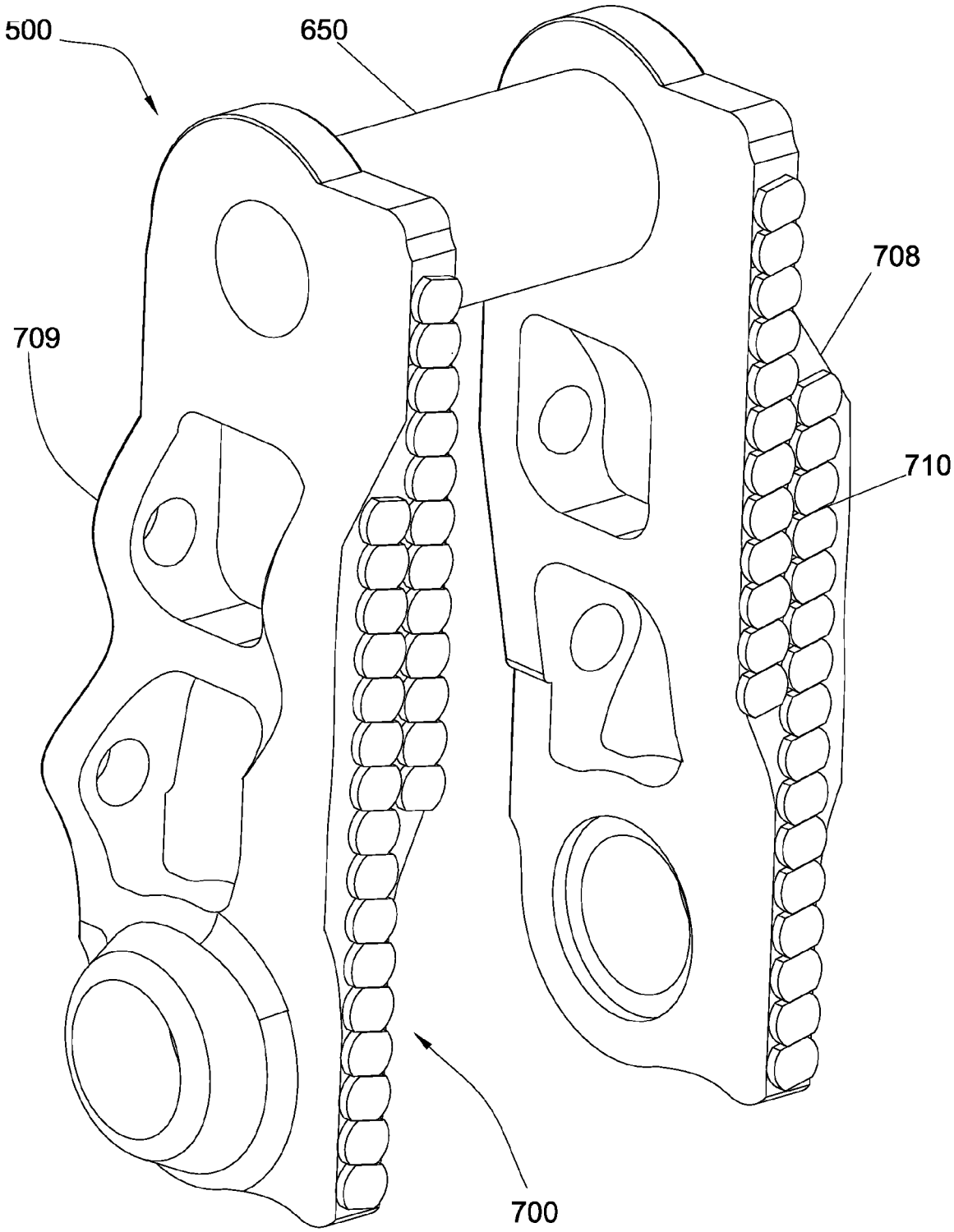
FIG. 7 is a perspective diagram of an embodiment of a chain link.

FIG. 7 discloses a perspective diagram of an embodiment of a chain link 500. The chain link 500 may comprise a first side 709 and a second side 708 connected through a pin sleeve 650. A portion of the chain link 500 may comprise the inserts. In this embodiment, the inserts are lined up against each other such that they contact. The sides of the inserts comprise flats which allow the inserts to get closer to one another and allow the sliding surface to be more constant. In embodiments, where the inserts are made in a high temperature high pressure press, the inserts are typically formed in a cylindrical shape, thus forming a flat in the inserts may be more economic than forming the inserts in a substantially square or rectangular shape.

Figure 8:
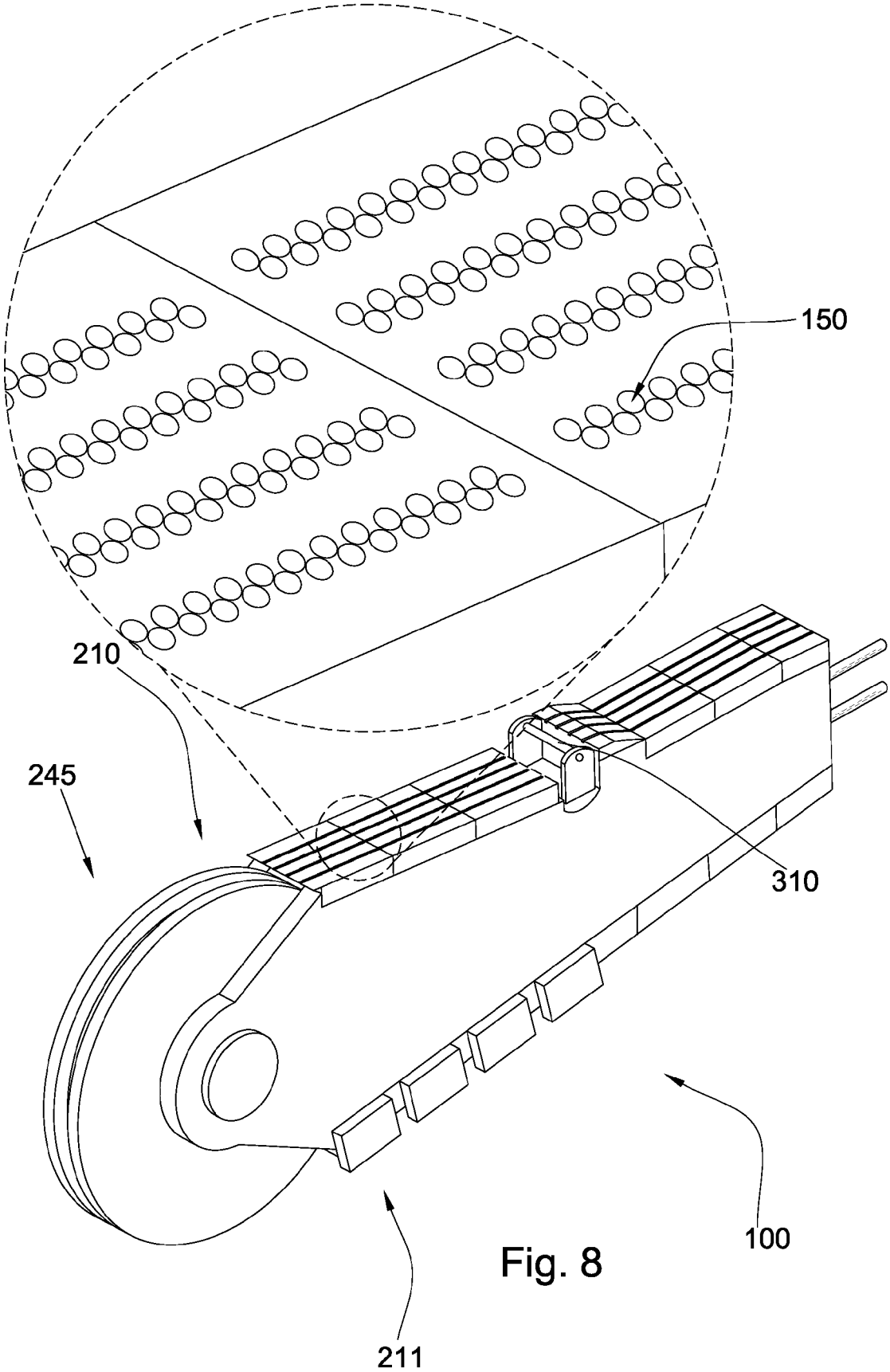
FIG. 8 is a perspective diagram of an embodiment of a boom.

FIG. 8 discloses a perspective diagram of an embodiment of a boom 100 without the links and the degradation plates for purposes of illustration. The boom 100 may be lined with inserts 150 along the topside 210 as well as the underside 211 of the boom. It is believed that the majority of the wear may occur on the underside of the boom where it is typically loaded against the formation, although some wear may occur on the top side of the boom as well. In some embodiments the wheels 245, 310 and/or sprockets (not shown) of the boom may also be enhanced with ceramic enhanced inserts. In this embodiment, the tops of the inserts are flush with the surface of the wear plates attached to the top side of the boom.

Figure 9A:
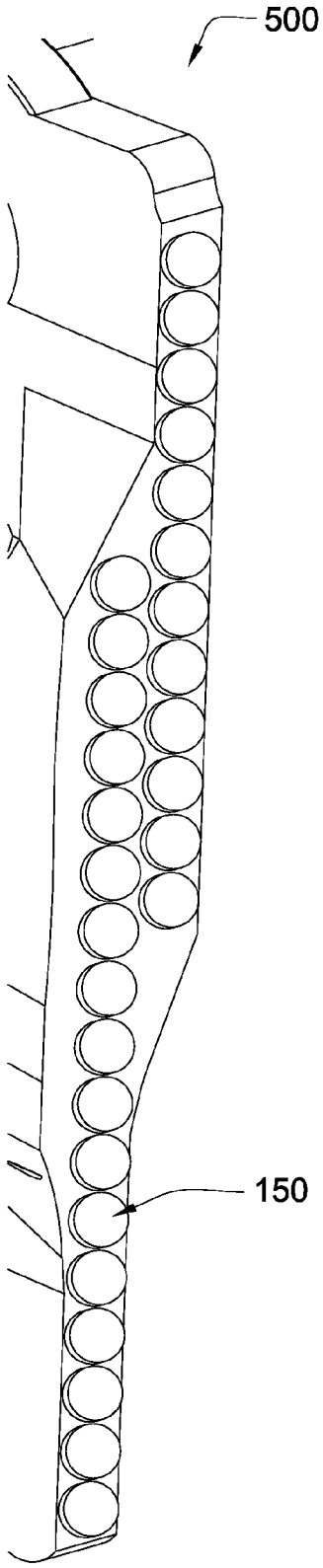
FIG. 9*a* is a perspective diagram of an embodiment of a chain link.
Figure 9B:
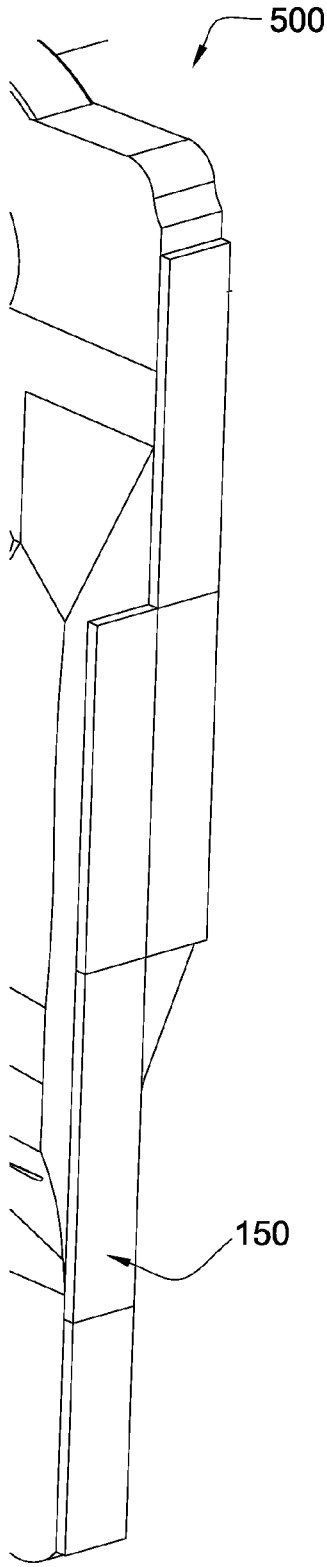
FIG. 9*b* is a perspective diagram of an embodiment of a chain link.
Figure 9C:
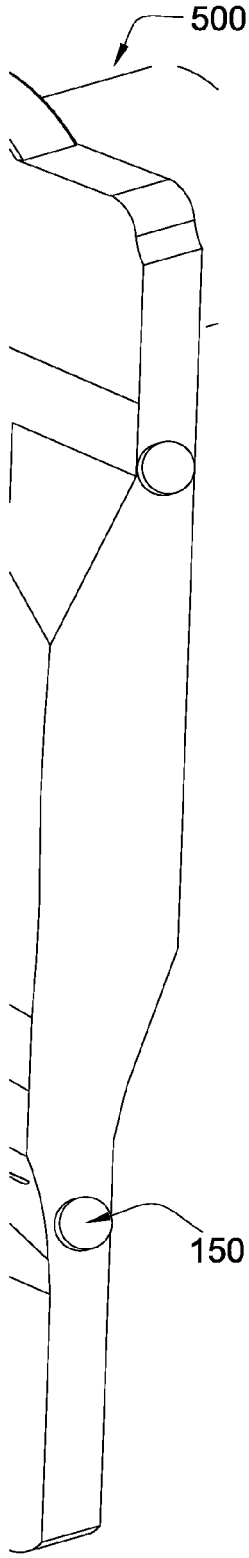
FIG. 9*c* is a perspective diagram of an embodiment of a chain link.

FIGS. 9*a-c* disclose a portion of a chain link 500 comprising plurality of inserts. The inserts 150 may be circular, rectangular, square or a combination thereof. In some embodiments, the inserts 150 substantially line the length of the chain link 500. In other embodiments, the chain link 500 may only comprise one or two inserts 150 as can be seen in FIG. 9*c*. It is believed that in some cases, having only one or two inserts 150 may be sufficient to substantially reduce the wear on the boom 100.

Figure 10A:
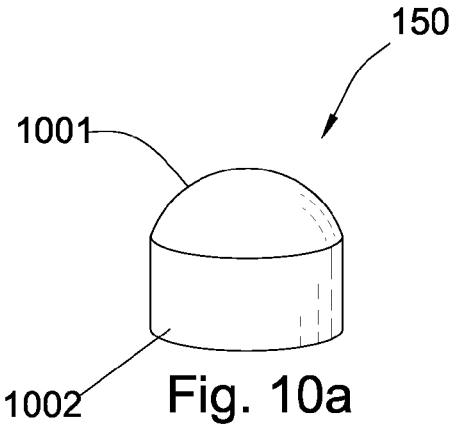
FIG. 10*a* is a perspective diagram of an embodiment of an insert.
Figure 10B:
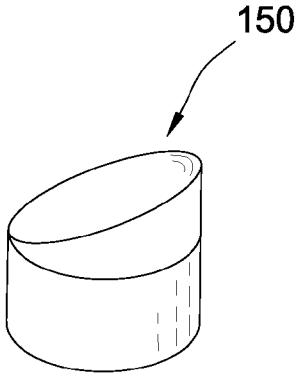
FIG. 10*b* is a perspective diagram of another embodiment of an insert.
Figure 10C:
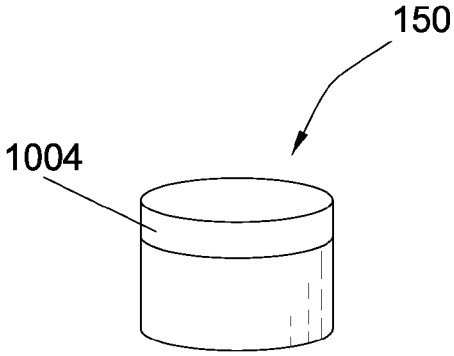
FIG. 10*c* is a perspective diagram of another embodiment of an insert.

FIGS. 10*a-c* disclose embodiments of inserts 150 that may be compatible with the present invention. The inserts may comprise a domed portion 1001 bonded to a substrate 1002. In some embodiments, the inserts may comprise an anglecut 1003 adapted to lift and/or vibrate the links in a controlled manner. In some embodiments, vibrations may be used to induce a destructive frequency into the formation enabling higher rates of degradation. The inserts may also comprise a flatted upper portion 1004. In some embodiments the inserts are a unitary mass, such as in some of the embodiments comprising carbide inserts. In other embodiments, the inserts may have two dissimilar materials bonded to one another.

Figure 11A:
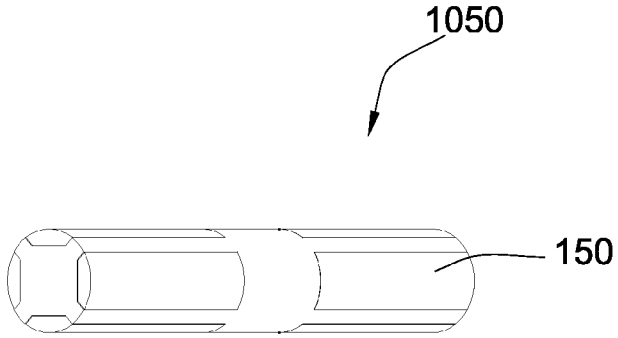
FIG. 11*a* is a perspective diagram of an embodiment of a link pin.
Figure 11B:
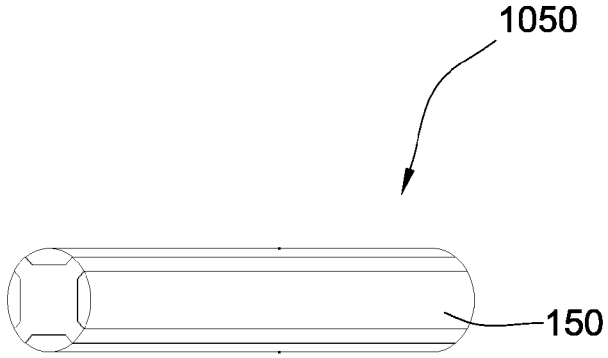
FIG. 11*b* is a perspective diagram of another embodiment of a link pin.
Figure 11C:
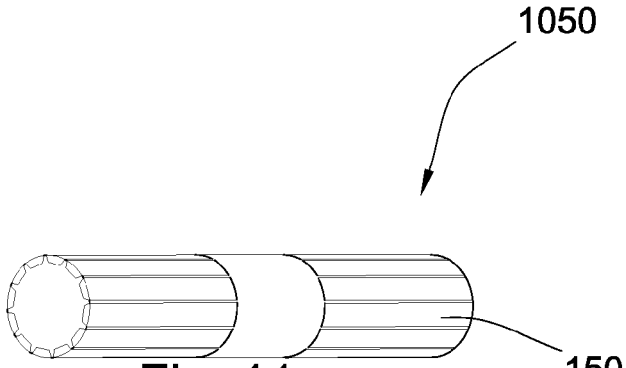
FIG. 11*c* is a perspective diagram of another embodiment of a link pin.

FIGS. 11*a-c* disclose perspective diagrams of chain pins 1050 which are receivable in the pin sleeves 650 (see FIG. 7) and are adapted to hold adjacent links to of the chain assembly together. The pins may also be enhanced with a hard wear resistant 150 such as ceramics, sintered diamond, deposited diamond, cubic boron nitride, carbide, cemented metal carbides, silicon carbide, or combinations thereof. The inserts may be pressed or bonded into recesses formed in the pins. In some embodiments, the inserts span the length of the pin and in other embodiments, the inserts are segmented. Since wear resistant material is typically more expensive than the traditional steels that are used in the pins, a segmented insert may reduce costs since the wear resistant material is only applied in the regions exposed to the most wear. Also wear resistant material is generally more brittle than traditionally used steels and are more likely to crack. The segments may reduce the likelihood that a crack formed in an insert will propagate through the length of the pin.

Figure 12:
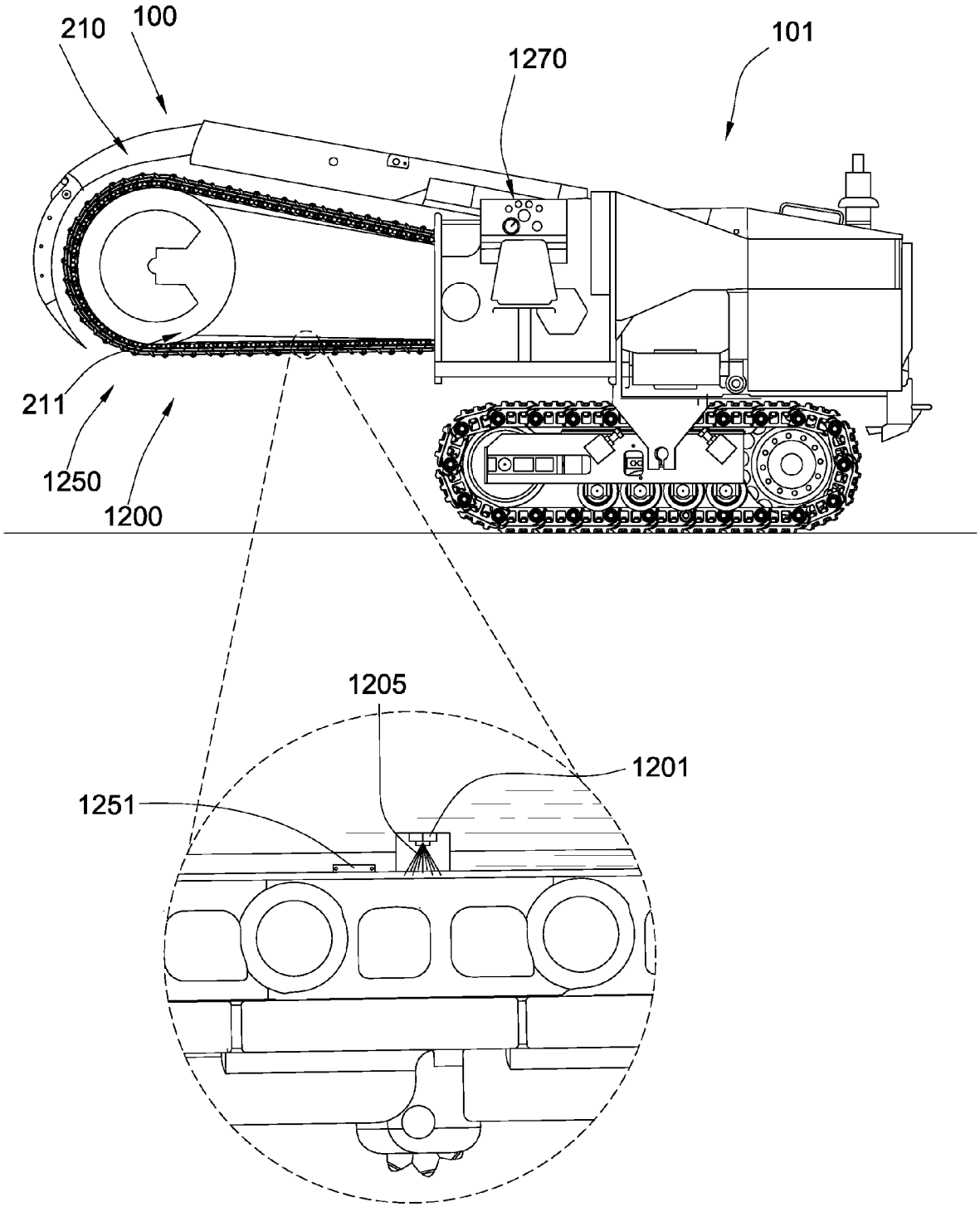
FIG. 12 is a perspective diagram of an embodiment of a trenching machine.

FIG. 12 discloses a perspective diagram of an embodiment of a trenching machine 101 with a dispenser 1200 and temperature sensing assembly 1250. The temperature sensing assembly 1250 may comprise a thermocouple 1251 adapted to find the temperature of the boom 100 during operation. The thermocouple 1251 may be in electrical communication with a gauge 1270 through an inductive, hardwire or wireless interface. The temperature sensing assembly 1250 may also be in electrical communication with the dispenser 1200. The dispenser 1200 may comprise a plurality of nozzles 1201 disposed on the topside 210 and underside 211. The dispenser 1200 may receive a signal from the temperature sensing assembly 1250. The dispenser 1200 may be adapted to apply a coolant 1205 and/or lubricant to the sliding surface.

Figure 13:
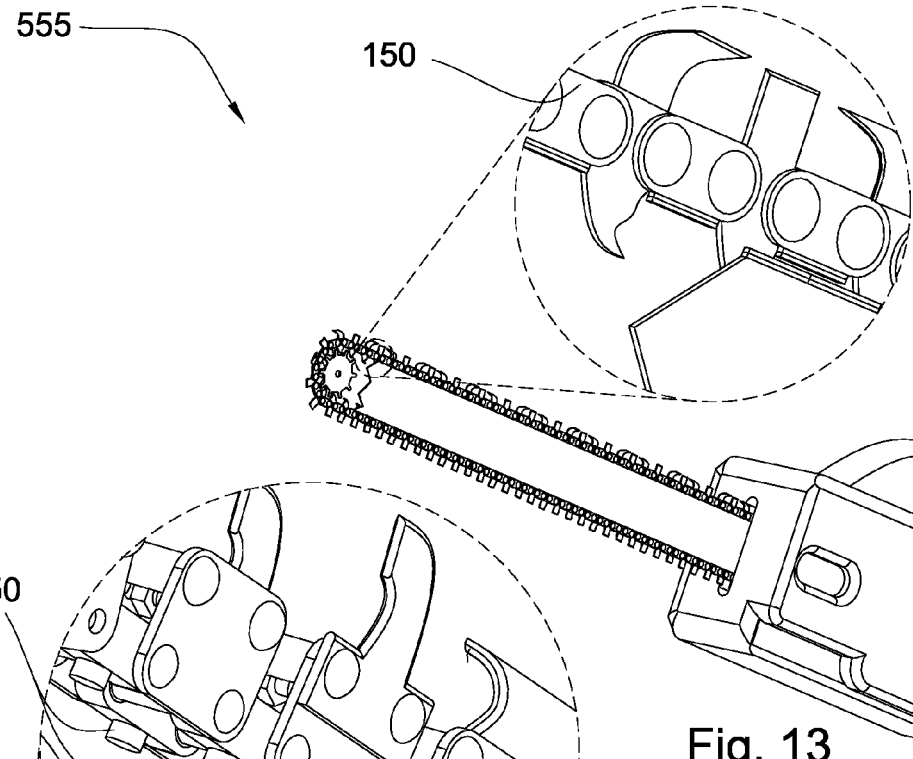
FIG. 13 is a perspective diagram of an embodiment of a saw.

FIG. 13 discloses a perspective diagram of an embodiment of a chain saw 555. The chain links may comprise inserts 150. The saw 555 may be used in felling, limbing, and bucking applications. The saw 555 may be gas or electric-powered. The inserts 150 may be disposed in areas of wear. The inserts may be attached to the links and/or boom.

Figure 14:
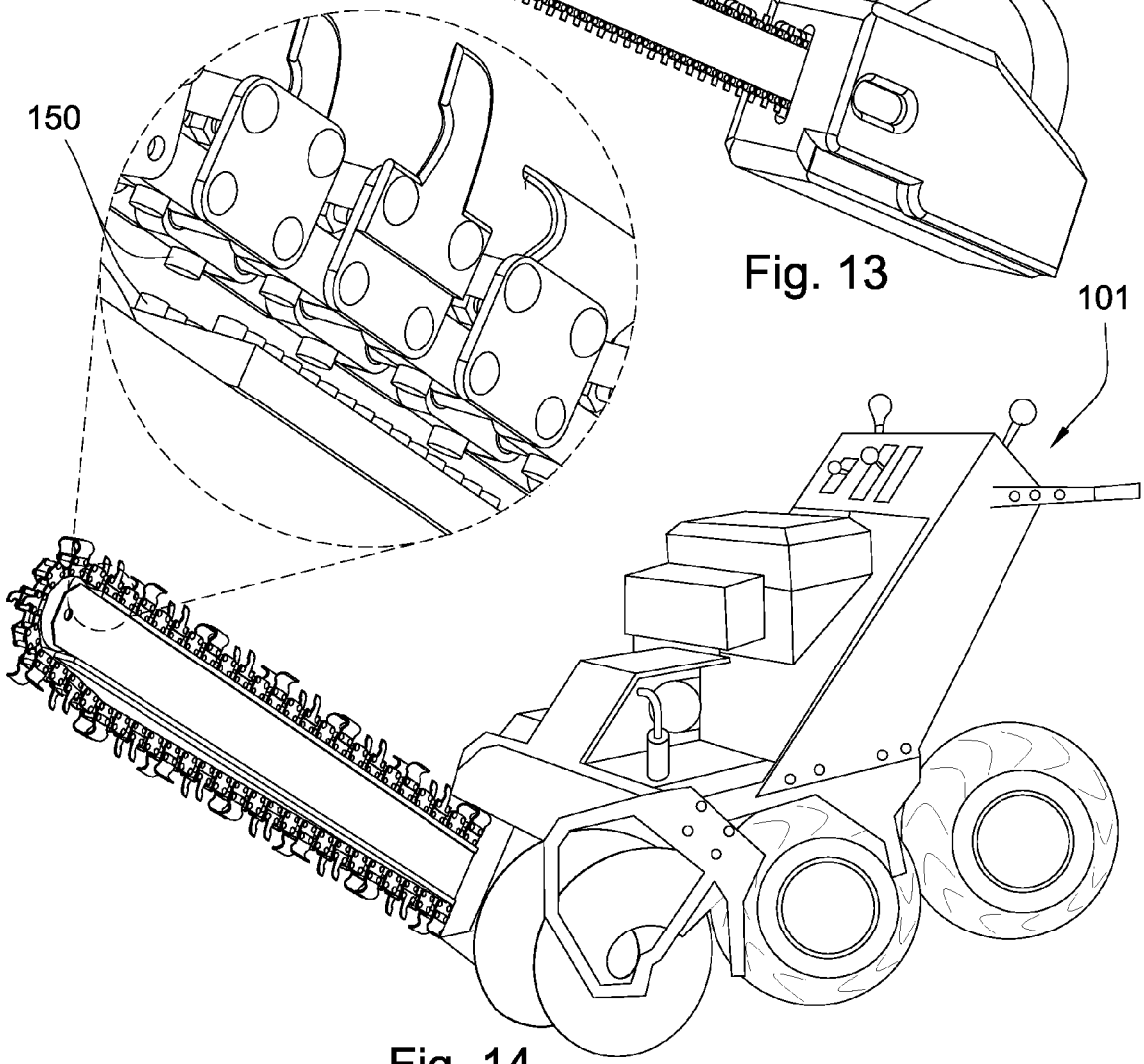
FIG. 14 is a perspective diagram of another embodiment of a trenching machine.

FIG. 14 discloses a perspective diagram of an embodiment of a trencher 101. The trencher 101 may comprise a plurality of chain links. The trencher may be adapted to be manually operated.

Figure 15:
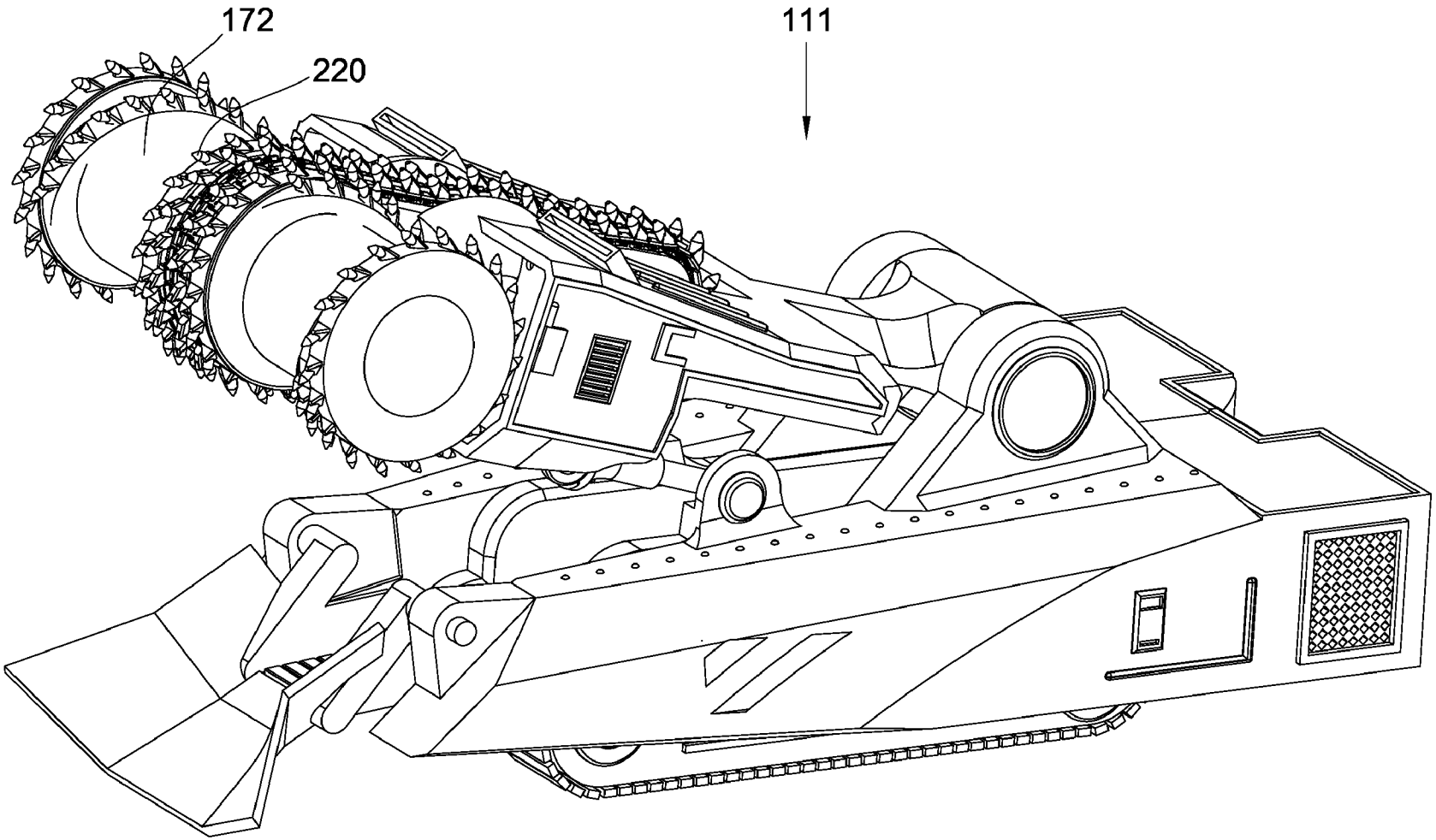
FIG. 15 is a perspective diagram of an embodiment of a mining machine.

FIG. 15 discloses a perspective diagram of an embodiment of a mining machine 111. The mining machine 111 may comprise a chain assembly adapted to degrade a formation and drive a drum 172 with a plurality of picks 220.

Whereas the present invention has been described in particular relation to the drawings attached hereto, it should be understood that other and further modifications apart from those shown or suggested herein, may be made within the scope and spirit of the present invention.

What is claimed is:

1. A chain assembly, comprising:

a boom comprising a sliding surface and a plurality of chain links adapted to slide along the sliding surface;

at least one polycrystalline ceramic enhanced insert at an interface between the plurality of chain links and at least a portion of the sliding surface; and wherein a track is formed in the sliding surface and the track comprises at least one groove.

2. The assembly of claim 1, wherein the ceramic comprises a polycrystalline diamond.

3. The assembly of claim 1, wherein the ceramic comprises a cemented metal carbide.

4. The assembly of claim 1, wherein the ceramic comprises a cubic boron nitride.

5. The assembly of claim 1, wherein the at least one insert is attached to at least one of the plurality of chain links.

6. The assembly of claim 1, wherein the at least one insert is attached to the sliding surface.

7. The assembly of claim 1, wherein the boom is incorporated into an excavator.

8. The assembly of claim 1, wherein the boom is incorporated into a saw.

9. The assembly of claim 1, wherein the groove is lined with a wear resistant material.

10. The assembly of claim 1, wherein the track comprises at least one protrusion.

11. The assembly of claim 1, wherein the at least one insert is attached to a wear plate in part making up the sliding surface.

12. The assembly of claim 1, wherein the chain assembly further comprises at least two links arranged across the width of a degradation plate and an insert is bonded to a single side of each link.

13. The assembly of claim 1, wherein at least one of the plurality of chain links comprises at least one insert on a front end and a rearward end of the link.

14. The assembly of claim 1, wherein the link comprises a pin adapted to connect the link to an adjacent link, the pin comprises also comprising a ceramic enhancement.

15. The assembly of claim 1, wherein the boom comprises a pivot end attached to a vehicle.

16. The assembly of claim 1, wherein the boom is incorporated into a trenching machine.

17. A chain assembly, comprising:

a boom comprising a sliding surface and a plurality of chain links adapted to slide along the sliding surface;

at least one polycrystalline ceramic enhanced insert is attached to at least one of the chain links;

wherein the insert is adapted to slide against the sliding surface; and wherein a track is formed in the sliding surface and the track comprises at least one groove.

18. A chain assembly, comprising:

a boom comprising a sliding surface and a plurality of chain links adapted to slide along the sliding surface;

at least one polycrystalline ceramic enhanced insert is bonded to the sliding surface;

wherein the insert is adapted to slide against the plurality of chain links; and wherein a track is formed in the sliding surface and the track comprises at least one groove.

* * * * *